US006361476B1

(12) United States Patent
Eschenbach

(10) Patent No.: US 6,361,476 B1
(45) Date of Patent: Mar. 26, 2002

(54) VARIABLE STRIDE ELLIPTICAL EXERCISE APPARATUS

(76) Inventor: Paul William Eschenbach, 143 Lakeland Ave., Moore, SC (US) 29369

( * ) Notice: Subject to any disclaimer, the term of this patent is extended or adjusted under 35 U.S.C. 154(b) by 0 days.

(21) Appl. No.: 09/550,914

(22) Filed: Apr. 17, 2000

Related U.S. Application Data

(63) Continuation-in-part of application No. 09/488,593, filed on Jan. 24, 2000, now Pat. No. 6,210,305, which is a continuation-in-part of application No. 09/361,328, filed on Jul. 27, 1999, now Pat. No. 6,042,512.

(51) Int. Cl.[7] ..... A63B 69/16; A63B 22/04
(52) U.S. Cl. ..... 482/52; 482/57; 482/51
(58) Field of Search ..... 482/51, 52, 53, 482/57, 70, 79, 80

(56) References Cited

U.S. PATENT DOCUMENTS

| | | | | |
|---|---|---|---|---|
| 5,685,804 A | | 11/1997 | Whan-Tong | |
| 5,743,834 A | | 4/1998 | Rodgers | |
| 5,779,599 A | * | 7/1998 | Chen | 482/57 |
| 5,788,610 A | | 8/1998 | Eschenbach | |
| 5,836,854 A | | 11/1998 | Kuo | |
| 5,893,820 A | | 4/1999 | Maresh et al. | |
| 5,895,339 A | | 4/1999 | Maresh | |
| 5,919,118 A | | 7/1999 | Stearns et al. | |
| 5,921,894 A | | 7/1999 | Eschenbach | |
| 5,993,359 A | * | 11/1999 | Eschenbach | 482/57 |
| 5,997,445 A | | 12/1999 | Maresh et al. | |
| 6,027,431 A | | 2/2000 | Stearns et al. | |
| 6,042,512 A | * | 3/2000 | Eschenbach | 482/52 |
| 6,077,196 A | * | 6/2000 | Eschenbach | 482/51 |
| 6,090,014 A | * | 7/2000 | Eschenbach | 482/52 |

* cited by examiner

*Primary Examiner*—Stephen R. Crow

(57) ABSTRACT

The present invention relates to a standup exercise apparatus that simulates walking, jogging and climbing with arm exercise. More particularly, the present invention relates to an exercise machine having separately supported pedals for the feet and arm exercise coordinated with the motion of the feet. Cross trainers guide the feet along a generally elliptical shaped curve to simulate the motions of jogging and climbing. Existing machines often produce user problems resulting from improper stride length or excessive ankle articulation. The present invention is an improved elliptical exercise machine capable of extended exercise with fewer user problems. Further, the cross trainer is adjustable to vary the motion of the elliptical stride from walking to climbing. A foot support member is guided by a guide on one end and drives a control linkage on the other end. The resulting pedal motion is independently adjustable in stride length and ellipse orientation during operation. Handles are provided for coordinated arm exercise that adjusts with stride adjustment.

26 Claims, 6 Drawing Sheets

VARIABLE STRIDE ELLIPTICAL EXERCISE APPARATUS

This application is a continuation-in-part of Ser. No. 09/488,593 filed Jan. 24, 2000 now U.S. Pat. No. 6,210,305 which is a continuation-in-part of Ser. No. 09/361,328 filed Jul. 27, 1999 that has issued as U.S. Pat. No. 6,042,512.

BACKGROUND OF THE INVENTION

1. Field

The present invention relates to a standup exercise apparatus that simulates walking and jogging with arm exercise. More particularly, the present invention relates to an exercise machine having separately supported pedals for the feet and arm exercise coordinated with the motion of the feet. The pedal stroke can be changed during operation of the exercise apparatus.

2. State of the Art

The benefits of regular exercise to improve overall health, appearance and longevity are well documented in the literature. For exercise enthusiasts the search continues for safe apparatus that provides full body exercise for maximum benefit in minimum time.

Recently, a new category of exercise equipment has appeared on the commercial market called elliptical cross trainers. These cross trainers guide the feet along a generally elliptical shaped curve to simulate the motions of jogging and climbing. Generally they are large exercise machines using long cranks to generate a long foot stride. There is a need for a compact elliptical exercise machine capable of a similar long stride using a significantly shorter crank. Further, there is a need to adjust the length of the elliptical stride to accommodate users having different leg lengths.

Numerous combinations of levers and cranks to combine exercise for arms and feet can be found. Hex in U.S. Pat. No. 4,645,200 combines arm and foot levers for sit down exercise while Bull et al. in U.S. Pat. No. 4,940,233 combines arm and foot levers for standup exercise.

Lucas et al. in U.S. Pat. No. 4,880,225 offer oscillating arm levers coupled to the foot crank by a connecting rod. Dalebout et al. in U.S. Pat. Nos. 4,971,316 and 5,000,444 also shows oscillating swing arms coupled to the foot crank by an offset second crank and connecting rod. Lom in U.S. Pat. No. 4,986,533 offers oscillating arms driven by a crank-slider coupled to a foot crank.

Recently, there has been an effort to improve the up and down motion of stair climbers by the addition of horizontal movements. Habing in U.S. Pat. Nos. 5,299,993 and 5,499,956 offers an articulated linkage controlled through cables by motor to move pedals through an ovate path. Both pedal pivots follow basically the same guidance path curve directed by a motor controller. Stearns in U.S. Pat. No. 5,299,993 shows a stair stepping exercise machine which incorporates horizontal movement using a combination of vertical parallelogram linkage and horizontal parallelogram linkage to guide the foot pedals. The parallelogram linkages serve to maintain the pedal at a constant angle relative to the floor during a pedal cycle. The pedal pivots move through similar undefined guide paths.

Standup cycling is described in various patents such as U.S. Pat. No. 3,563,541 (Sanquist) which uses weighted free pedals as load resistance and side to side twisting motion. Also U.S. Pat. Nos. 4,519,603 and 4,477,072 by DeCloux describe standup cycling with free pedals in a lift mode to simulate body lifting.

Standup pedal exercise is shown in U.S. Pat. No. 4,643,419 (Hyde) and by Jarriel et al. in U.S. Pat. No. D330,236 where pedal platforms move by dual crank motion but remain parallel to the floor. Knudsen in U.S., Pat. No. 5,433,680 shows an elliptical path generating mechanism with pedals having only one pivot allowing the pedal to rotate unconstrained about the pivot as in a bicycle crank.

Standup pedal exercise combined with arm levers attached to the pedals is shown in Kummerlin et al. German Pat. No. 2,919,494 and in Geschwender U.S. Pat. No. 4,786,050. Standup pedal exercise coupled with oscillating swing arms is shown in Miller U.S. Pat. Nos. 5,242,343 and 5,383,829 and in Eschenbach U.S. Pat. No. 5,423,729. All of these exercise machines use pedals having two pedal pivots which are guided by a first circular guide path curve generated by a crank which rotates through one full revolution during a pedal cycle and a second arc guide path curve generated by a rocker link or track.

Recently, numerous elliptical exercise machines have appeared in the patent literature. Rogers, Jr. in U.S. Pat. Nos. 5,527,246, 5,529,555, 5,540,637, 5,549,526, 5,573,480, 5,591,107, 5,593,371, 5,593,372, 5,595,553, 5,611,757, 5,637,058, 5,653,662 and 5,743,834 shows elliptical pedal motion by virtue of various reciprocating members and geared linkage systems. Miller in U.S. Pat. Nos. 5,518,473, 5,562,574, 5,611,756, 5,518,473, 5,562,574, 5,577,985, 5,755,642 and 5,788,609 also shows elliptical pedal motion using reciprocating members and various linkage mechanisms along with oscillating guide links with control links to determine pedal angles. Ryan et al. in U.S. Pat. No. 5,899,833 shows an elliptical cross trainer having a forward crank being driven by a pedal linkage underneath the operator.

Chang in U.S. Pat. No. 5,803,872 and Yu et al. in U.S. Pat. No. 5,800,315 show a pedal supported by a rocker link and driven with a pair of links located under the pedal pivotally connected to a crank. Maresh et al. in U.S., Pat. No. 5,792,026 show a foot support member supported by a rocker link and driven by a double crank mechanism. Lee in U.S. Pat. No. 5,779,598 shows a pedal link driven by two separate cranks.

Lee in U.S. Pat. No. 5,746,683 shows a foot support member supported on one end with a compound rocker wherein a slider and handle lever support the rocker. Kuo in U.S. Pat. No. 5,836,854 offers a linear foot support member connected on one end to a crank and guided along an arcuate curve under the pedal by a linkage on the other end. Wang et al. U.S. Pat. No. 5,830,112 shows a foot support member sliding on a pivot on one end and attached to a crank on the other that can fold.

Chen U.S. Pat. Nos. 5,779,599 and 5,762,588 shows an elliptical pedal movement with a roller interface between the foot support member and crank but does not anticipate changing the pedal stroke length during operation. Chen in U.S. Pat. No. 5,759,136 shows a foot support member with a moving pedal for adjustable elliptical motion wherein a link from the pedal to the crank can be repositioned while not in operation to change the pedal stroke length. Stearns et al. in U.S. Pat. No. 6,027,430 also shows manual adjustment for elliptical pedal motion.

Maresh in U.S. Pat. No. 5,895,339 offers an elliptical foot motion that can be changed by tilting the crank assembly forward or rearward by actuator. Stearns et al. in U.S. Pat. No. 5,919,118 show two actuators that change the proportions of a drive linkage to change the foot path of an elliptical exerciser. Maresh et al. in U.S. Pat. Nos. 5,893,820 and 5,997,445 show several adjustment devices that will change the foot motion of elliptical trainers.

Stearns et al. in U.S. Pat. No. 6,027,431 and Rodgers U.S. Pat. No. 5,743,834 show gear and screw mechanisms to change the length of a rotary crank during operation which drives a linkage to generate elliptical pedal motion. A longer crank length will produce a longer pedal stroke but also causes an undesirable higher pedal lift. Eschenbach U.S. Pat. Nos. 5,788,610 and 6,042,512 shows a linkage mechanism to generate an elliptical pedal path wherein the orientation of the elliptical pedal curve can be changed during operation. Eschenbach in U.S. Pat. No. 5,993,359 offers a variable stroke elliptical exercise apparatus wherein a control linkage adjusts the stride of the foot path by actuator.

There is a need for a pedal operated exercise machine that can be safely operated in the standup position whereby the arms and legs can be exercised with the feet moving through a generally elliptical path wherein the operator can select different pedal stride lengths and arm exercise during operation of the exercise apparatus without complicated gear mechanism.

It is one objective of this invention to provide a variable stride elliptical pedal movement wherein the pedal stroke length can be changed during operation while the pedal lift remains generally the same. Another object of this invention is to provide arm exercise that changes to accommodate taller or shorter users.

SUMMARY OF THE INVENTION

The present invention relates to the kinematic motion control of pedals which simulate walking and jogging during operation. More particularly, apparatus is provided that offers variable intensity exercise through a leg operated cyclic motion in which the pedal supporting each foot is guided through successive positions during the motion cycle while a load resistance acts upon the mechanism.

The pedals are guided through an oblong or elongate curve motion while pedal angles are controlled to vary about the horizontal during the pedal cycle. Arm exercise is by arm levers coordinated with the mechanism guiding the foot pedals.

In the preferred embodiment, the apparatus includes a separate pedal for each foot, each pedal is supported by a foot support member which is pivotally attached on one end to a roller which rides on a guide attached to the framework. A portion of the foot support member is supported on the other end by a roller rotatably attached to a rotary crank. The crank completes one full revolution during a pedal cycle and is phased generally opposite the crank for the other foot support link through a crankshaft rotatably attached to the framework. The crank determines the lift of the pedal while the generally horizontal stride length of the pedal movement is determined by a control linkage.

The control linkage is intended to take the crank motion as an input and to transform the rotary crank motion into variable reciprocating movement controlling the back and forth foot support member movement to produce a variable stride pedal motion. The control linkage consists of: a first control link pivotally connected to the crank; a second control link pivoted to the framework and pivotally connected to the first control link; a third control link pivotally connected to the foot support member and the second control link. The pin joint connection common to both the second and third control links is movable along the length of the second control link to adjust the stride length of the pedal motion.

As the crank rotates, the first control link provides reciprocating movement to an intermediate portion of the second control link. The third control link couples the upper portion of the second control link to the foot support member to produce a predetermined pedal curve length. The pivot at one end of the third control link is attached to a collar that can be repositioned along the upper offset portion of the second control link. The shorter pedal curve length occurs with the collar near the middle of the second control link while the longest pedal curve occurs with the collar near the end of the second control link.

A spring is contained inside the second control link to bias the collar towards the end of the second control link. A cable is attached to the collar and directed through the second control link pivot at the framework. The cable terminates at an actuator which is attached to the framework. Movement of the linear actuator during operation or without an operator creates tension in the cable to compress the spring and lower the collar on the second control link for a shorter pedal stride. Pedal stroke can be varied from 15" to 30" in a commercial form of the preferred embodiment by programmed control or operator interface during operation of the exercise apparatus.

In an alternate embodiment, the roller and roller guide at the forward end of the foot support member is replaced with a rocker link pivotally connected to one end of the foot support member and to the framework. The rocker link extends upward for arm exercise which changes with changes in pedal stride length. The collar on the second control link is repositioned to other locations by the manual adjustment. A remotely operated solenoid locks the collar to the second control link.

In another alternate embodiment, the roller guide is adjustable to vary the orientation of the pedal curve independently of the curve stride adjustment. A gear rack is attached to the second control link in contact with a gear rotatably attached to the collar which can move along the length of the second control link. A remotely operative motor determines the position of the gear on the rack to choose the pedal curve length.

Of course, other means of positioning the collar along the length of the second control link such as an actuator attached to the second control link, hydraulic cylinders, etc. are all within the scope of this invention. The present invention allows independent adjustment of pedal stroke and ellipse orientation during operation of the exercise apparatus.

In each embodiment, the pedal is moved by the foot of the user where the pedal follows an elongate curve path while the foot support member moves back and forth with an orbital movement as the crank rotates. Load resistance is applied to the crank in each embodiment by a pulley which drives a belt to a smaller pulley attached to an alternator and flywheel supported by the framework. In each embodiment, the flywheel must overcome the torque provided by the alternator. Adjustment of the alternator electronics provides variable intensity exercise for the operator.

In summary, this invention provides the operator with stable foot pedal support having adjustable motions that simulate walking and jogging with very low joint impact while offering variable strides and lift during operation from an exercise machine with coordinated upper body exercise.

DETAILED DESCRIPTION OF THE EMBODIMENTS

Figure 1:
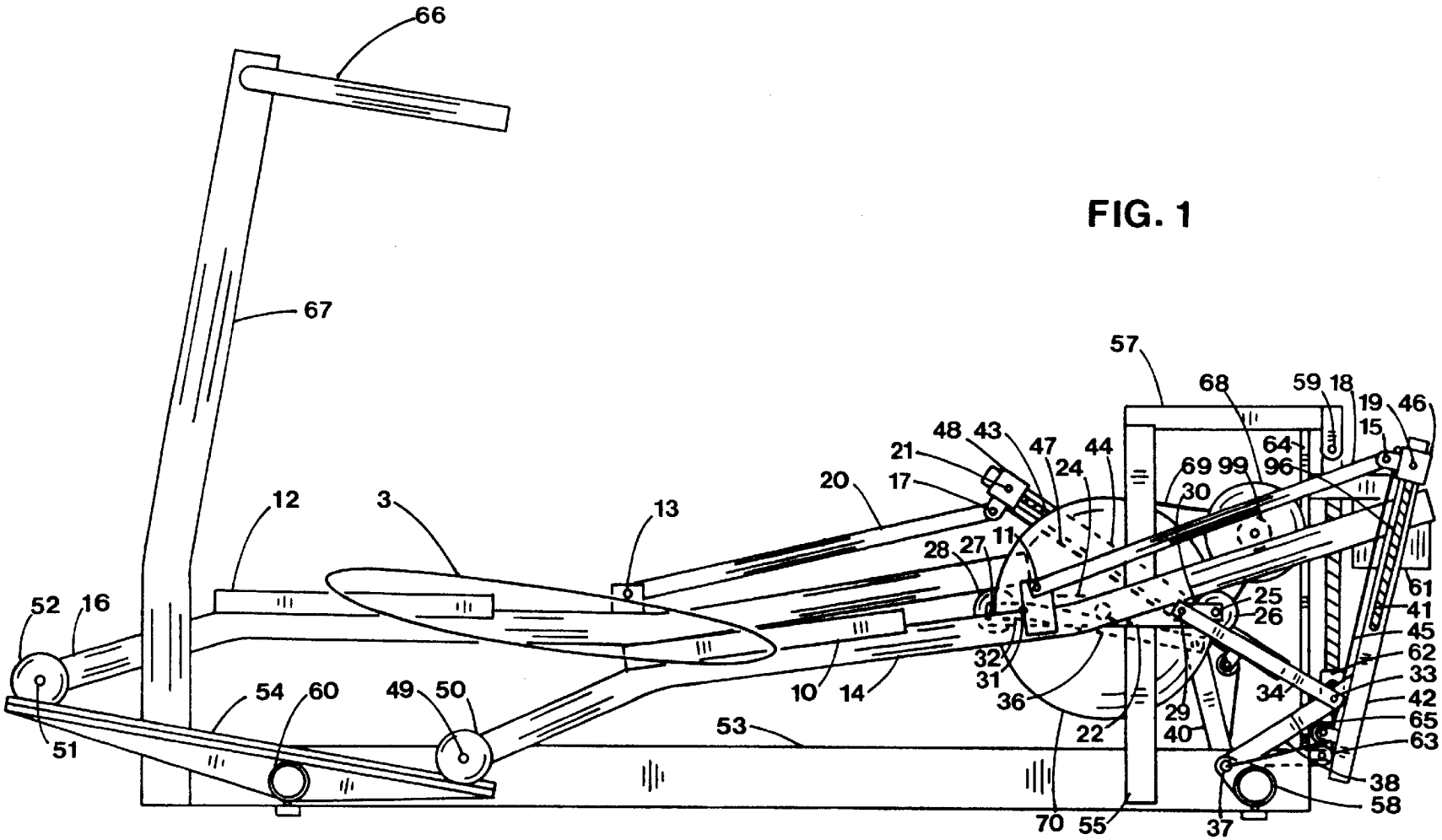
FIG. 1 is a right side elevation view of the preferred embodiment of an exercise machine adjusted to a long pedal stride constructed in accordance with the present invention.
Figure 2:
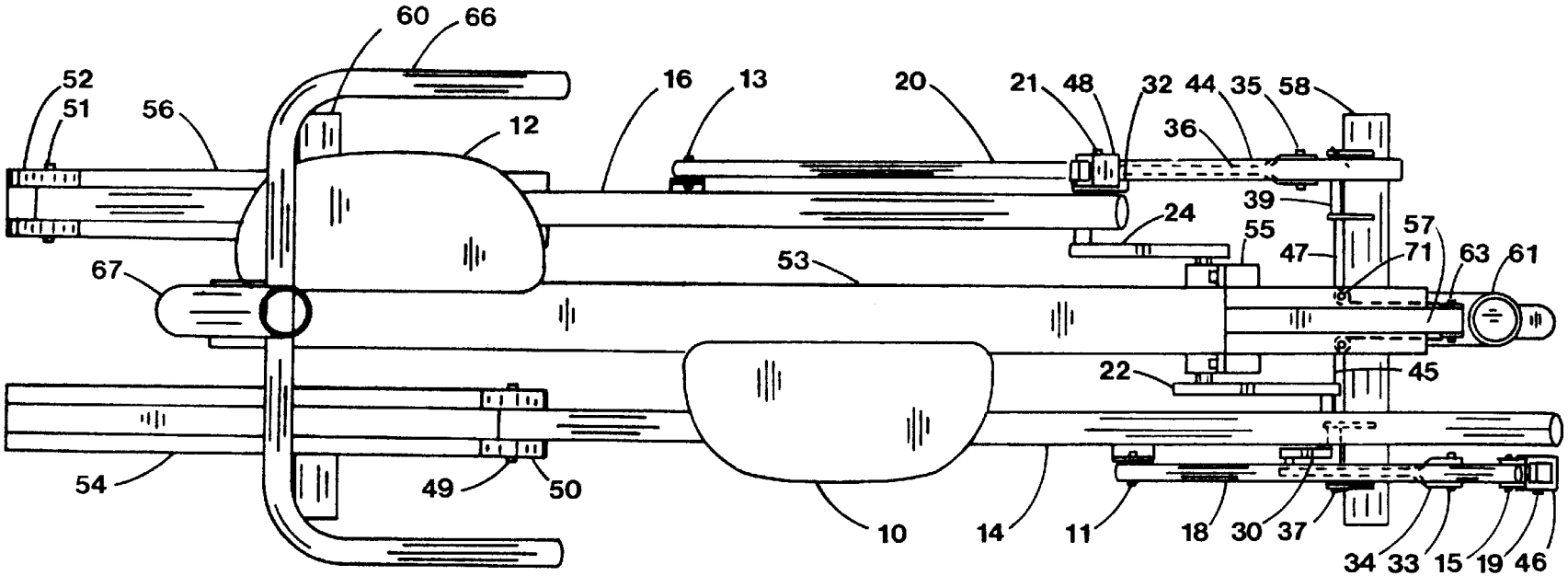
FIG. 2 is the plan view of the preferred embodiment shown in FIG. 1.
Figure 3:
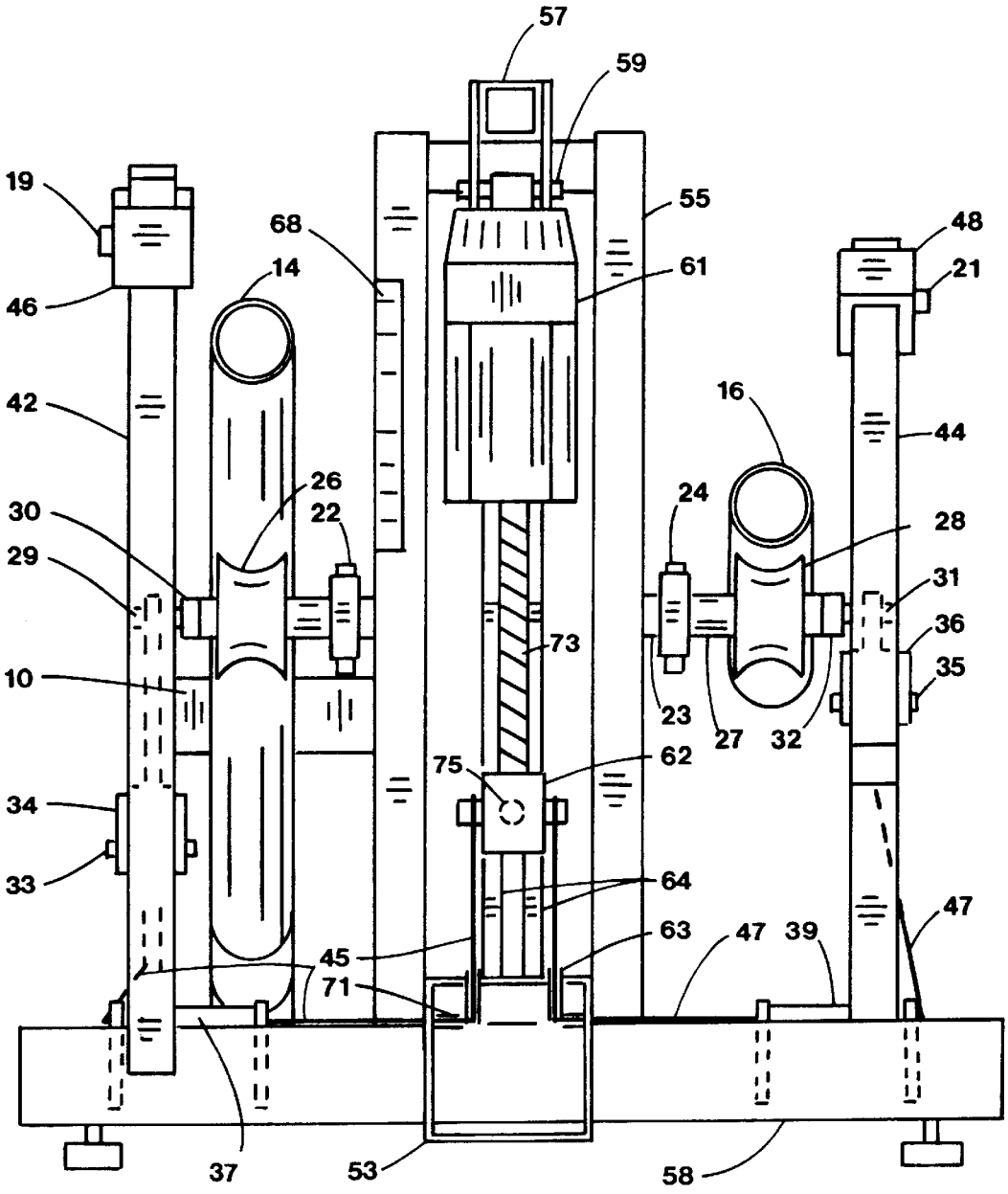
FIG. 3 is a rear view of the preferred embodiment shown in FIG. 1.

Referring to the drawings in detail, pedals 10 and 12 are shown in FIGS. 1, 2 and 3 in the most forward and rearward positions of the preferred embodiment. Pedals 10 and 12 are attached to foot support members 14,16 which are supported by rollers 26,28 along one end and connected to rollers 50,52 at pivots 49,51 at the other end. Rollers 50,52 are in rollable contact with guides 54,56 which are attached to frame member 60.

Rollers 26,28 are rotatably attached to crank pins 25,27. Crank pins 25,27 are attached to crank arms 22,24 which are joined by crankshaft 23 rotatably attached to frame member 55 and protrude outwardly in generally opposing directions. The crank arms 22,24 continue through crank pins 25,27 as offset crank arms 30,32 terminating as offset crank pins 29,31. Offset crank pins 29,31 are closer in radius to crankshaft 23 than crank pins 25,27.

A pair of control linkage determines the length of each pedal 10,12 stride. Each control linkage comprises: a first control link 34,36 rotatably attached to offset crank pin 29,31; a second control link 38,40 connected to framework 58 at pivot 37,39 and pivotally connected to the first control link at pivot 33,35. The second control link 38,40 extends upward at an angle as extension 42,44. Collar 46,48 is slidably connected to extension 42,44. A third control link 18,20 is connected to collar 46,48 at pivot 15,17 and to foot support member 14,16 at pivot 11,13.

Spring 41,43 is housed internal to extension 42,44 and impinges an upward force upon collar 46,48 through pin 19,21 which passes through slot 96,98. Cable 45,47 is attached to collar 46,48 and travels down extension 42,44, passing over pulley 65 into pivot 37,39, around pulleys 71 and 63 up to screw nut 62. Actuator 61 is connected to frame member 57 at pivot 59 and couples screw 73 with screw nut 62.

Actuator 61 is electrically connected to a control system (not shown) which determines the position of the screw nut 62 upon screw 73. As the screw 73 turns, a guide pin 75 rides in vertical guide rails 64 to prevent the screw nut 62 from turning. As screw 73 turns, screw nut 62 moves upward pulling cables 45,47 through pivots 37,39 causing collars 46,48 to move downward upon extensions 42,44 to compress springs 41,43.

As the crank 22,24 turns, extension 42,44 oscillates to move the foot support member 14,16 back and forth in synchronous with the roller 26,28 which is lifting one end of the foot support member 14,16 causing pedal 10,12 to move along ellipse curve 3. A long stride 3 occurs with collar 46,48 near the end of extension 42,44 while a short stride 5 occurs with collar 46,48 pulled down on the extension 46,48 as shown in FIG. 4.

Frame member 53 connects cross members 58,60 which contact the floor for support of the exercise machine. Frame members 55 connect to frame member 53 to support crank shaft 23 and frame member 57. Frame upright member 67 is supported by frame member 53 to support handle 66 for upper body support.

Load resistance is imposed upon crank arm 22 by pulley 70 which drives flywheel/alternator 68 by belt 69 coupled to flywheel pulley 99. The flywheel/alternator 68 is supported by the frame member 55. Other forms of load resistance such as belt friction, magnetic, air, etc. may also be used.

Figure 4:
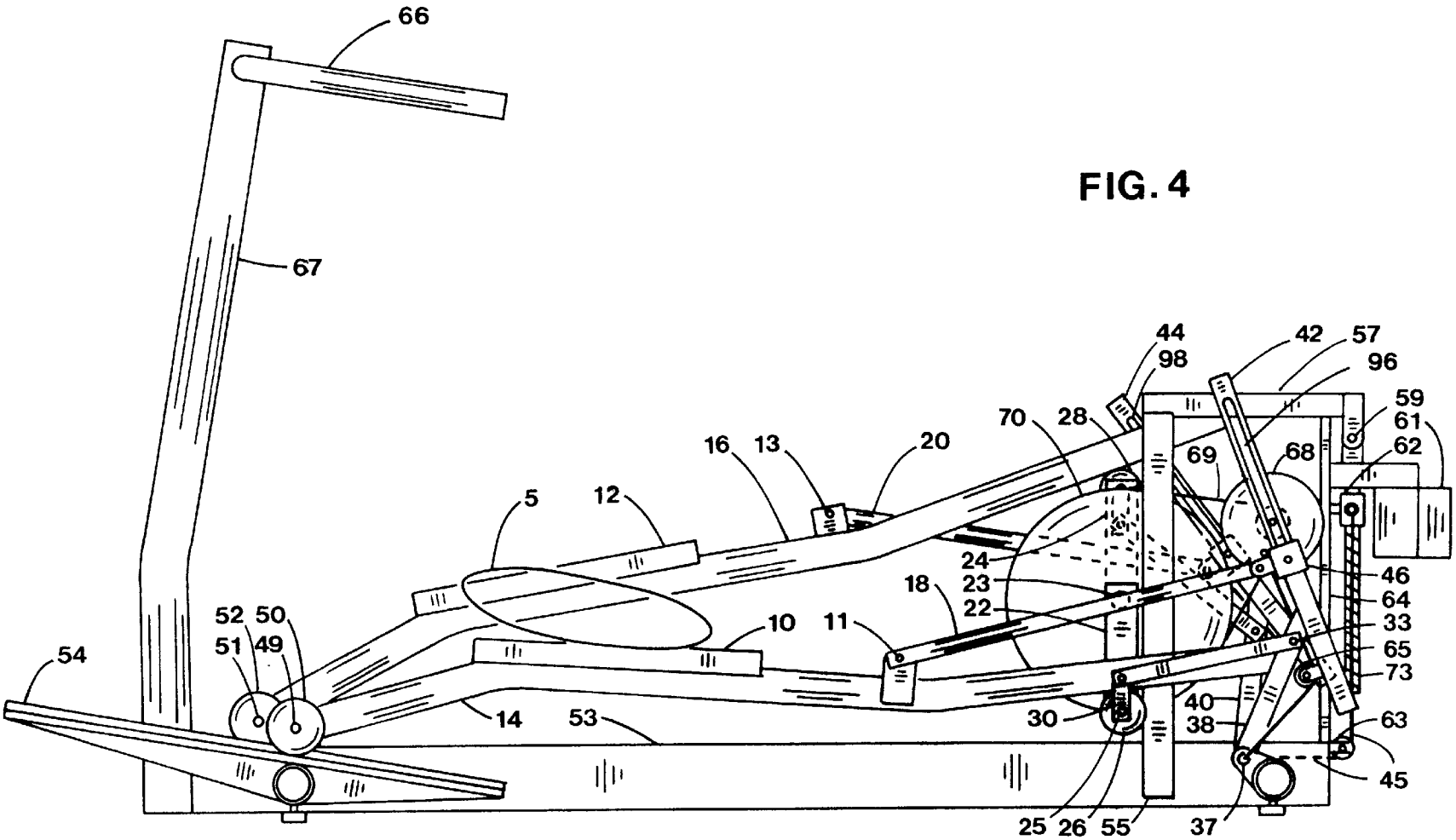
FIG. 4 is a right side view of the preferred embodiment adjusted to a short pedal stride.

Application of body weight on the pedals 10,12 causes the pedals 10,12 to follow elliptical curve 3 shown in FIG. 1, elliptical curve 5 in FIG. 4 or any predetermined curve length in between to cause the linkage to rotate the flywheel 68 for a gain in momentum. This flywheel 68 momentum will carry the linkage system through any dead center positions of the crank arms 22,24. The pedals 10,12 can be operated to drive the flywheel 68 in either direction of rotation.

Figure 5:
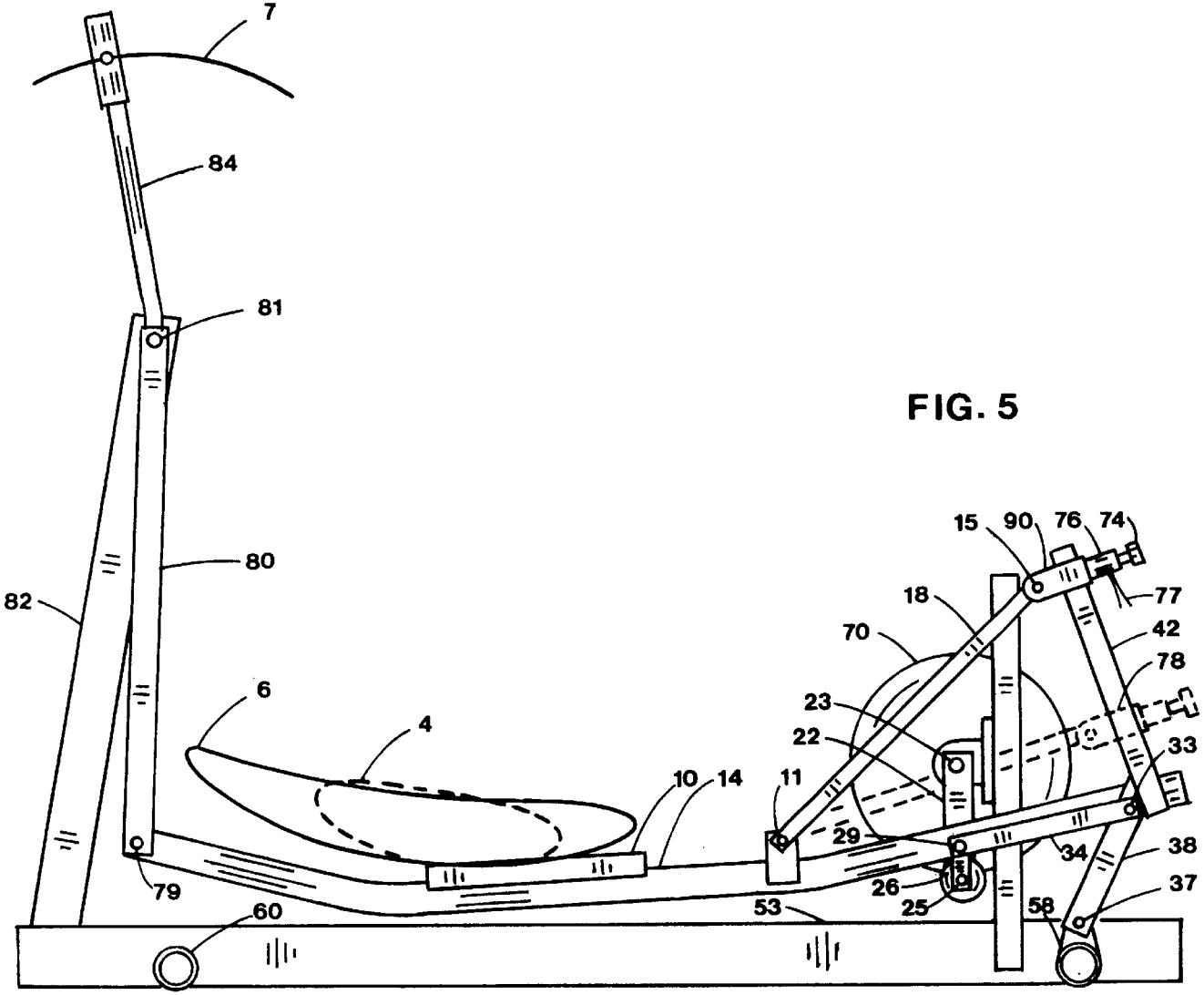
FIG. 5 is a right side schematic of an alternate embodiment showing only the left hand linkage members.

An alternate embodiment is shown in FIG. 5 with pedal 10 in the lowermost position where only the left hand linkage is given for clarity. The foot support member 14 and control linkage are the same as the preferred embodiment. Roller 50 and roller guide 54 are replaced with rocker 80 connected to foot support member 14 at pivot 79 and to upright support 82 at pivot 81. Handle 84 extends upward from rocker 80 for arm exercise with the hand following curve 7. Collar 90 is fixed to extension 42 with solenoid 76 which is operative from a remote location via wires 77. Alternately, knob 74 can be manually released to reposition collar 90. Pedal curve 6 occurs with collar 90 in the upper position while pedal curve 4 occurs when the collar 90 is repositioned to position 78. Extension 42 is angularly offset relative to second control link 38 to maintain pedal curve 4 generally in the midsection of pedal curve 6 so arm exercise comfort is maintained.

Figure 6:
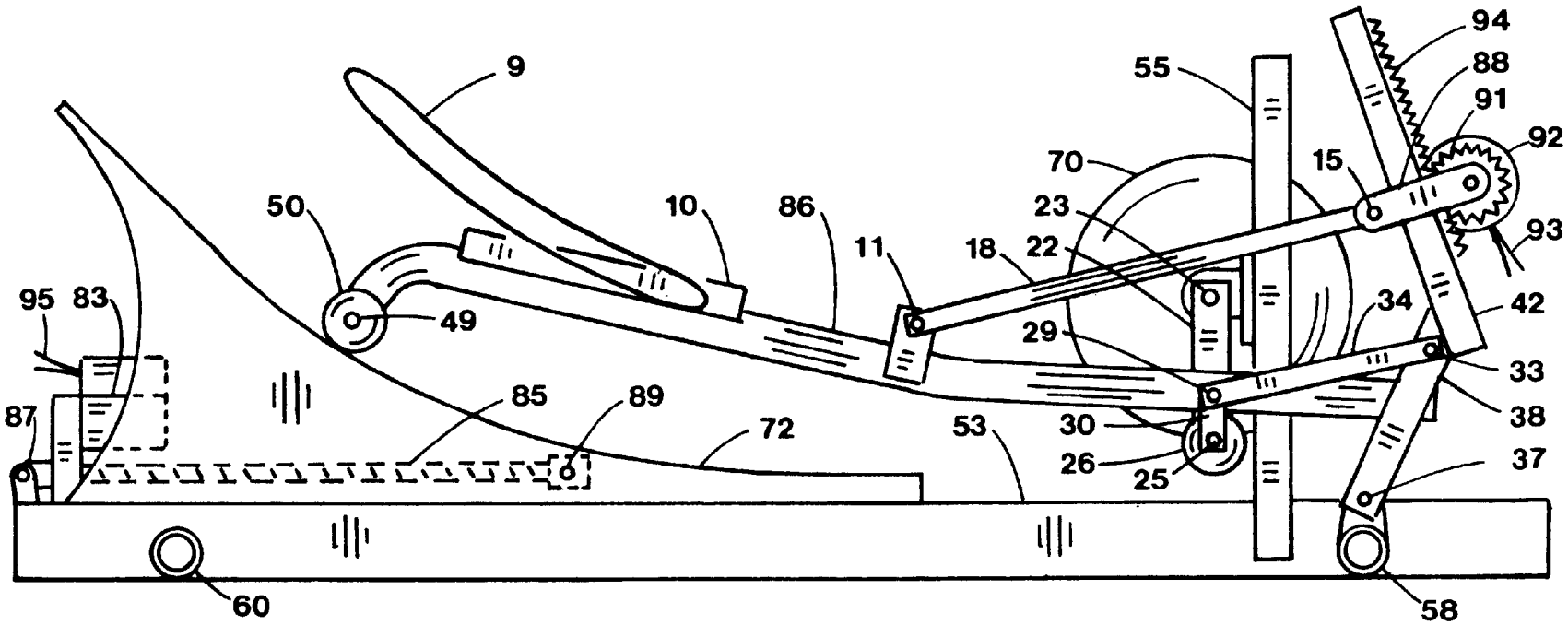
FIG. 6 is a right side schematic of an another alternate embodiment showing only the left hand linkage members.

In another alternate embodiment shown in FIG. 6 with pedal 10 in the lowermost position for the left hand linkage, foot support member 14 has roller 50 in contact with curved guide 72. Actuator 83 is connected to curved guide 72 at pivot 89 and to the frame member 53 at pivot 87. As the actuator 83 is controlled remotely through wires 95, screw 85 causes the screw nut 89 to move the curved guide 72 horizontally back and forth to change the orientation of pedal curve 9. Pedal curve 9 and curved guide 72 are shown in a climb position. Moving the curved guide forward causes the incline of pedal curve 9 to become more horizontal. Of course, other forms of guide repositioning may also be used.

The control linkage is the same as the preferred embodiment shown in FIG. 1. However, an alternate means is given to move the collar 88 upon extension 42. Motor 92 is attached to collar 88 and drives gear 91 along rack 94 which is attached to extension 42 by remote control through wires 93. Of course, other means of collar 88 adjustment such as an actuator, air cylinder or hydraulic cylinder, etc., could also be attached to extension 42 instead of motor 92 to move collar 88 along extension 42.

FIG. 6 shows an independent means 88,91,92,94 to change the pedal curve 9 length and an independent means 72,83,85 to change the pedal curve 9 incline. Either or both means of adjustment can be operated remotely from a control system (not shown) during operation of the exercise machine or while not in use.

In summary, the present invention has distinct advantages over prior art because both the back and forth stride movement of the pedals can be changed as well as the pedal curve incline independently during operation to accommodate the pedal stride and incline preference of the user. Arm exercise is also adjusted during operation when desired by the operator.

The present invention may be embodied in other specific forms without departing from its spirit or essential characteristics. The described embodiments are to be considered in all respects only as illustrative, and not restrictive. The scope of the invention is, therefore, indicated by the claims, rather than by foregoing description. All changes which come within the meaning and range of equivalency of the claims are to be embraced within their scope.

What is claimed is:

1. An exercise machine comprising;

a framework configured to be supported on the floor;

a crank means rotatably connected to said framework, said crank means projecting outwardly therefrom on both sides thereof;

a pair of guide means, said guide means operably associated with said framework;

a pair of roller means, said roller means operably associated with said crank means;

a foot support member for each foot, said foot support member having a portion supported by said roller means and operably associated with said guide means to move with a generally back and forth orbital movement;

a control linkage, said control linkage having a plurality of control links positioned rearward said exercise machine, operably associated with said crank means and said foot support member;

a pedal means operably associated with said foot support member to move along an elongate curve path having a predetermined curve length;

a means for adjustment, said means for adjustment operably associated with said control linkage and said foot support member to cause a change in the relationship between said control links when desired by the operator;

said pedal means configured to move relative to said framework when the foot of the operator is rotating said crank means whereby said predetermined curve length can be changed.

2. The exercise machine according to claim 1 wherein the means for adjustment is an actuator, said actuator operably associated with said control linkage to change the predetermined curve length during operation of said exercise machine.

3. The exercise machine according to claim 1 wherein said means for adjustment comprises the repositioning of a pin joint, said pin joint being common to a pair of control links.

4. The exercise machine according to claim 3 further comprising a cable means, said cable means operably associated with said pin joint and said framework to reposition said pin joint relative to one of said control links.

5. The exercise machine according to claim 4 further comprising an actuator, said actuator operably associated said cable means and said framework to change the predetermined curve length during operation of said exercise machine.

6. The exercise machine according to claim 1 wherein said guide means comprises a rocker link, said rocker link pivotally connected to said framework and to said foot support member to guide one end of said foot support member along an arcuate path.

7. The exercise machine according to claim 1 wherein said guide means comprises a roller means rotatably connected proximate one end of said foot support member and a track means attached to said framework to guide one end of said foot support member along a guide path.

8. The exercise machine according to claim 1 further comprising a means to adjust said guide means whereby the orientation of said elongate curve may be changed by said means to adjust said guide means independently of said predetermined curve length.

9. The exercise machine according to claim 1 wherein said control linkage comprises a first control link pivotally connected to said crank means;

a second control link pivotally connected to said first control link and said framework, and a third control link pivotally connected to said second control link and to said foot support member.

10. The exercise machine according to claim 9 wherein said third control link can be repositioned relative to said second control link whereby the predetermined curve length is changed.

11. The exercise machine according to claim 10 further comprising a gear rack, said gear rack operably associated with said second control link and a motor means to reposition said third control link.

12. The exercise machine according to claim 10 further comprising an actuator means, said actuator means attached to said second control link and operably associated with said third control link.

13. The exercise machine according to claim 10 further comprising a solenoid means, said solenoid means remotely operative to release the connection between said second and third control links for repositioning.

14. The exercise machine according to claim 1 further comprising means for arm exercise operably associated with said foot support member.

15. The exercise machine according to claim 1 further comprising means for arm exercise wherein said means for arm exercise is operably associated with said guide means.

16. The exercise machine according to claim 1 further comprising a means for load resistance operably associated with said crank means.

17. The exercise machine according to claim 9 further comprising a collar, said collar movably attached to said second link and pivotally connected to said third control link whereby said third control link may be repositioned relative to said second control link.

18. An exercise machine comprising;

a framework configured to be supported on the floor;

a crank means rotatably connected to said framework, said crank means projecting outwardly therefrom on both sides thereof;

a pair of roller means, said roller means operably associated with said crank means;

a pair of guide means, said guide means operably associated with said framework;

a foot support member for each foot, said foot support member having a portion supported by said roller means and operably associated with said guide means to move with a generally back and forth orbital movement;

a control linkage, said control linkage having a first control link pivotally connected to said crank means, a second control link pivotally connected to said first control link and said framework, a third control link pivotally connected to said second control link and said foot support member;

a pedal means operably associated with said foot support member;

said pedal means configured to move relative to said framework when the foot of the user is rotating said crank means whereby said pedal means follows an elongate curve.

19. The exercise machine according to claim 18 further comprising a means to adjust the length of said elongate curve, said means to adjust the length of said elongate curve operably associated with said control linkage.

20. The exercise machine according to claim 19 wherein the means to adjust the length of said elongate curve is an actuator, said actuator operably associated with said control linkage to change the length of said elongate curve during operation of said exercise machine.

21. The exercise machine according to claim 19 wherein said means to adjust the length of said elongate curve comprises the repositioning of said third control link relative to said second control link.

22. The exercise machine according to claim 21 further comprising a cable means, said cable means operably associated with said control linkage and said framework to reposition said third control link relative to said second control link.

23. The exercise machine according to claim 22 further comprising an actuator, said actuator operably associated said cable means and said framework to change the length of said elongate curve during operation of said exercise machine.

24. The exercise machine according to claim 18 further comprising a means for adjusting the guide path of said guide means during operation of said exercise machine.

25. The exercise machine according to claim 19 further comprising a gear rack, said gear rack operably associated with said second control link and a motor means to reposition said third control link.

26. The exercise machine according to claim 19 further comprising an actuator means, said actuator means attached to said second control link and operably associated with said third control link.

* * * * *